US006636703B2

(12) United States Patent
Deen et al.

(10) Patent No.: US 6,636,703 B2
(45) Date of Patent: Oct. 21, 2003

(54) DIGITAL IMAGE REPRODUCTION DEVICE WITH A DOUBLE-SHEET DETECTOR

(75) Inventors: Pieter Berend Johannes Deen, Eindhoven (NL); Frederik De Jong, Weert (NL)

(73) Assignee: Oce-Technologies B.V., Ma Venlo (NL)

( * ) Notice: Subject to any disclaimer, the term of this patent is extended or adjusted under 35 U.S.C. 154(b) by 0 days.

(21) Appl. No.: 09/987,659

(22) Filed: Nov. 15, 2001

(65) Prior Publication Data

US 2002/0057917 A1 May 16, 2002

(30) Foreign Application Priority Data

Nov. 15, 2000 (NL) ..... 1016616

(51) Int. Cl.[7] ..... G03G 15/00

(52) U.S. Cl. ..... 399/17; 399/18; 399/81; 399/371

(58) Field of Search ..... 399/16–18, 367, 399/371, 81

(56) References Cited

U.S. PATENT DOCUMENTS 5,130,807 A * 7/1992 Tanabe et al. ..... 399/371 X
5,383,631 A 1/1995 Mazzini
6,243,541 B1 * 6/2001 Shimizu ..... 399/17
6,466,748 B2 * 10/2002 Tamai et al. ..... 399/16

FOREIGN PATENT DOCUMENTS

EP 0 315 427 A 5/1989

OTHER PUBLICATIONS

Patent Abstracts of Japan, vol. 12, No. 201 (M–707), Jun. 10, 1998.
Patent Abstracts of Japan, vol. 10, No. 140 (P–458), May 23, 1986.
Patent Abstracts of Japan, vol. 2000, No. 4, Aug. 31, 2000.
European Search Report.

* cited by examiner

*Primary Examiner*—William J. Royer
(74) *Attorney, Agent, or Firm*—Birch, Stewart, Kolasch & Birch, LLP

(57) ABSTRACT

An image reproduction device is provided with an automatic feed unit for documents; a double-sheet detector for detecting more than one sheet as the document for copying; an operator control unit provided with an operator control panel; and a control unit for controlling the automatic feed unit, processing the signal from the double-sheet detector and controlling the operator control unit. The device which is also provided with an operator control unit adapted to offer a choice between switching the double-sheet detector on or off is thus suitable for the image reproduction of documents in cases in which, dependent on the presence of documents consisting of more than one sheet, the operator is offered the free choice of adapting the operation of the image reproduction device thereto.

8 Claims, 3 Drawing Sheets

DIGITAL IMAGE REPRODUCTION DEVICE WITH A DOUBLE-SHEET DETECTOR

BACKGROUND OF THE INVENTION

The present invention relates to an image reproduction device, comprising an automatic feed unit for documents; a double-sheet detector for detecting more than one sheet as the document for copying; an operator control unit provided with an operator control panel; and a control unit connected to the units for controlling the automatic feed unit, processing the signal from the double-sheet detector and controlling the operator control unit.

The term "image reproduction device" denotes a digital or analogue copying machine or a document scanner. In a device of this kind, one or more documents for copying are transported, by means of an automatic feed unit, one by one from an input tray to a positioning section where the document is scanned or imaged. In the case of a stack of several documents in the input tray, the documents have to be separated from one another by means of a separating mechanism.

Nevertheless, there are cases in which a plurality of sheets are taken simultaneously from the stack. As a result, it is then not possible to make good copies. Another consequence of this is that problems may occur during transport and there may be the risk that the original documents are damaged. The automatic processing of the documents then has to be interrupted.

To obviate the above disadvantages, a device is known from U.S. Pat. No. 5,383,631 in which a double-sheet detector is disposed within the automatic feed unit. This detector records whether the document being transported comprises a single sheet or a plurality of sheets, e.g. two or three sheets simultaneously. In this way it is possible to detect two originals inadvertently sticking together, thus increasing the reliability of the automatic original processing. If a plurality of sheets are detected, the printing job is interrupted and the originals are returned to the input tray to be fed to the device again. Depending on new double sheet detections, the procedure is repeated a number of times and then the printing job finally stops when the sheets are not successfully separated.

In a device of this kind it is a disadvantage that a so-called paste-up (a sheet on which something has been pasted) as the document for copying will be incorrectly classified as an error input. A document of this kind cannot be copied with the known device without an error message.

The object of the present invention is to provide a reproduction device which is adapted to be operated in a simple manner which is understandable and predictable for the user, and wherein copies of original documents can be made even if the document for copying is formed from more than one sheet.

To this end, according to the present invention, the operator control unit is adapted to offer a choice between switching the double-sheet detector on or off.

In this way, the device according to the present invention is suitable for the image reproduction of documents in cases where, depending on the presence of documents consisting of more than one sheet, the operator is offered the choice of adapting the operation of the image reproduction device thereto.

In one specific embodiment of the device according to the present invention, the operator control unit is adapted to offer, in the case of double-sheet detection, a choice between switching the double-sheet detector off or to leave it on.

In a device of this kind according to the present invention, upon a first double-sheet detection, the operator is offered, by means of a forced dialogue, the choice as to whether or not to switch off the double-sheet detection. If, in a set of documents for copying, a first paste-up is detected by means of the double-sheet detector, the operator is offered the choice of switching the detector off for the rest of the set. In such cases it is probable that there will be more paste-ups in the set. In this way, a set having a plurality of paste-ups can be copied without further interruptions.

If the device according to the present invention is provided with an automatic feed mode, in which the default setting of the double-sheet detector is switched on, the device is suitable for giving the operator, in the case of a first detection of double sheet documents, the option to leave the double-sheet detector switched on for the remaining reproduction process or, in the knowledge of the presence of paste-ups and the like, to continue the procedure without further interruption by opting for switching the detector off.

In a variant of the device according to the present invention, the automatic feed unit is provided with an optional manual feed mode. When this mode is used, the documents can be input to the feed unit one by one manually.

If the device according to the present invention, in one specific embodiment, is provided with an automatic feed unit having a manual feed mode wherein the double-sheet detector default setting is switched off, this has the advantage that the device is suitable for the reproduction of documents consisting of more than one single sheet, without interruption of the print job. The choice of a manual feed mode being offered is of itself sufficient to operate in this mode without problems with respect to double-sheet detection.

It is possible that the manual feed mode may be set by means of a selection menu on the operator control panel of the operator control unit. An alternative suggestion is that this mode may be set by means of a switch connected to the device according to the present invention. The switch can, for example, form part of the automatic feed unit.

The double-sheet detector may be positioned in various locations within the device. For example, it is possible to locate the double-sheet detector at the positioning section for the scanning of the document.

In one embodiment of the device according to the present invention, the automatic feed unit is provided with a separating mechanism and the double-sheet detector is positioned within the automatic feed unit. Preferably, the double-sheet detector is located in the vicinity of the separating mechanism. The effect of this is that the detection of more than one sheet, as the document, during the transport path from the input tray to the positioning section takes place at the beginning of the path and hence at an early time, if the double-sheet detector is placed near the separating mechanism. In this way the risk of transport problems is greatly reduced while at the same time the choice is offered to the operator early on via the operator control panel, to continue or interrupt the reproduction procedure.

The double-sheet detector used in the device according to the present invention may be an ultrasonic transmitter and receiver pair. In this case, the transmitter and receiver are located on either side of the transport path and hence on either side of a document for copying. As the document attenuates the signal transmitted by the transmitter, the signal is recorded by the receiver as an indication of the thickness of the document. From this it is possible to derive whether a single sheet or a plurality of sheets is involved.

The double-sheet detector may consist of a plurality of pairs each comprising a transmitter and receiver. In this way simultaneous detection at different locations is possible. In this way, for example, it is possible to detect whether the document consists of two adhering single sheets of equal size. If the document is a paste-up, in which, for example, just a part of the first sheet is covered by a second sheet, then when a double-sheet detector is used with a plurality of transmitter and receiver pairs such documents differing in form can be detected with respect thereto.

BRIEF DESCRIPTION OF THE DRAWINGS

The present invention will now be explained with reference to the accompanying drawings, in which like references are used for like parts, and wherein.

DETAILED DESCRIPTION OF THE INVENTION

Figure 1:
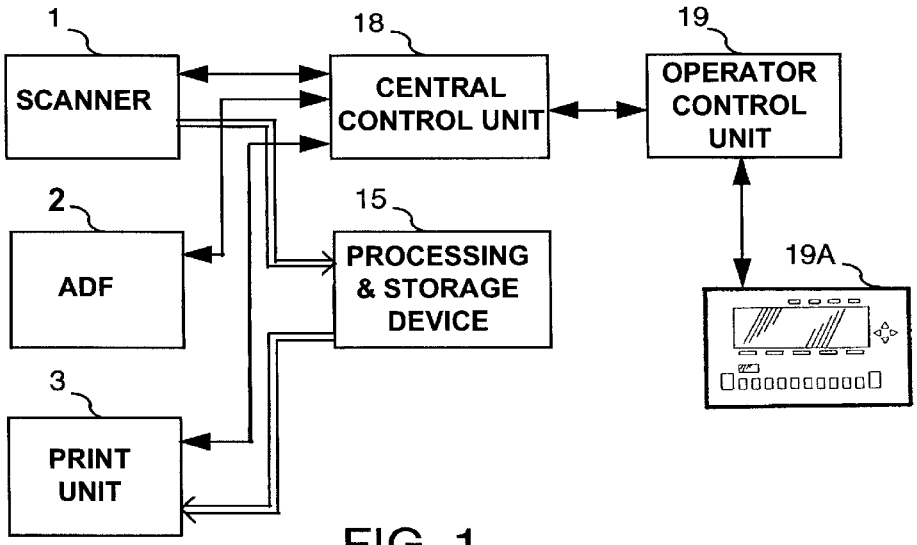
FIG. 1 is a general layout of a reproduction device according to the present invention.

FIG. 1 shows the general layout of one example of an image reproduction device according to the present invention. This device comprises a scanner 1 for opto-electrical scanning of a document and delivering of digital image information corresponding thereto, an automatic feed unit 2 for documents (ADF) and a print unit 3 for printing digital image information on a support material. A double-sheet detector is disposed in the automatic feed unit 2. The device can additionally be provided with a module for image information from an external source (not shown in FIG. 1).

Both the scanner 1 and the automatic feed unit 2 equipped with the double-sheet detector are connected to a processing and storage device 15 for processing and intermediate storage of image information, which is in turn connected to the print unit 3. The scanner 1, automatic feed unit 2, processing and storage device 15 and print unit 3 are connected to a central control unit 18, which is also connected to an operator control unit 19 provided with an operator control panel 19A with operator control elements and a display screen for use by the operator.

The operator control panel 19A belonging to the operator control unit 19 comprises a display screen, such as an LCD display, and a number of keys, namely a start key, number keys, correction key and selection keys and a key cluster. All these elements are connected to the operator control unit 19, which, in response to the operation of the keys, delivers signals to the central control unit 18 and also controls the display screen to display options and messages to the operator.

Figure 2:
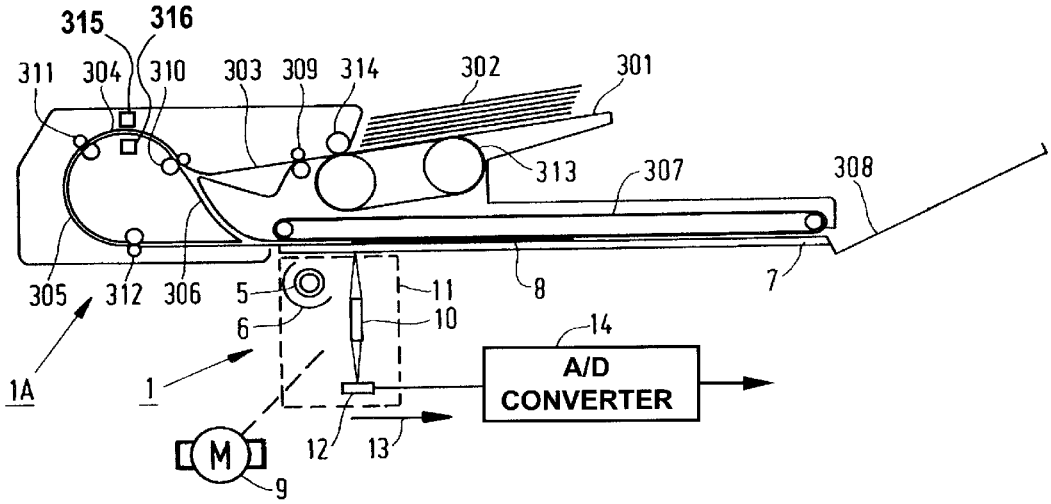
FIG. 2 shows a scanner device with a document feed unit.

The scanner 1 is shown in greater detail in FIG. 2. It is provided with a lighting tube 5 and a reflector 6 cooperating therewith, by means of which a narrow strip of a document 8 placed on the a glass plate 7 is exposed. The scanner 1, also contains an array of imaging glass fibers 10 (a selfoc lens array), by means of which the light reflected by the document 8 is projected onto a sensor array, for example a CCD array 12. The lighting tube 5, reflector 6, selfoc lens array 10 and CCD array 12 are combined on a carriage 11 which, during scanning, is advanced by a servomotor 9 at a uniform speed in the direction of the arrow 13, so that the document 8 is scanned line by line by the CCD array 12. The position of the carriage 11 is continuously measured by means known per se and is also used for the feedback circuit of the servomotor 9.

Thus each pixel of the document 8 is converted into an analogue signal corresponding to the grey value of that pixel. The analogue signal is then converted by an A/D converter 14 into a digital signal for each pixel.

The scanner 1 is equipped with the automatic feed unit (ADF) 2 which includes an input tray 301 for introducing a stack of documents 302 for copying, including one or more paste-ups or other multi-sheet documents, a separating mechanism 313, 314 for removing the documents, one by one, from the bottom of the stack, and a transport mechanism consisting of transport paths 303, 304, 305, 306 and transport roller pairs 309, 310, 311, 312, for transporting a removed document 8 to a positioning section in the form of the glass plate 7. Document 8 is transported over the glass plate 7 by a conveyor belt 307 which transports it to a delivery tray 308 after scanning by the carriage 11.

A double-sheet detector with a transmitter 315 and receiver 316 is disposed on either side of the transport path 304 as part thereof between the transport roller pairs 310 and 311.

Figure 3:
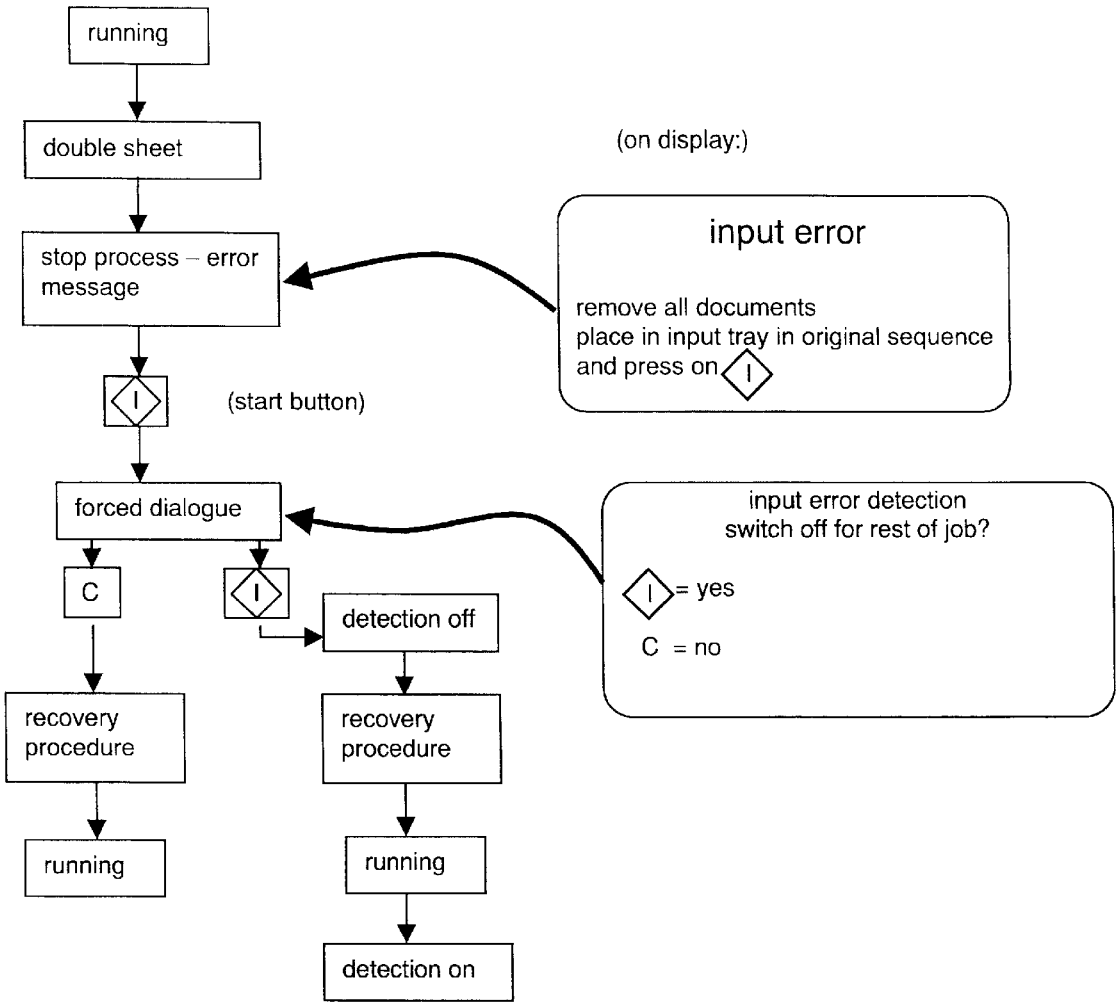
FIG. 3 is a flow diagram of the control program according to the present invention.

FIG. 3 is a flow diagram showing a control program according to the present invention. The central control program is operative in the control unit 18 of the device shown in FIGS. 1 and 2.

When a job is started for the reproduction of a number of original documents from the input tray 301, the described device is in an automatic feed mode with the double-sheet detector switched on as the default setting. It is possible to select this setting beforehand by means of the screen of the operator control unit 19.

As soon as a first document is detected by means of the double-sheet detector, the printing procedure is interrupted and the message of an input error occurs on the display screen. The operator is requested to remove all the documents from the automatic feed unit 2 and place them in the input tray 30 in the original sequence. The start button is then again actuated. A forced dialogue window now appears on the screen offering the operator the choice of either switching off the detection, which is currently switched on, for the rest of the job or to leave it on. Depending on their choice, the print job is continued starting with a recovery procedure, in which further checking for double-sheet documents may or may not take place.

As part of the control program as described, the display screen may display a message warning for a reduced security with respect to double-sheet separation if the operator selects switching off the double-sheet detector for the rest of the job.

Preferably, the device according to the present invention is provided with an operator control unit 19 which, with the control program described, automatically switches on the double-sheet detector after completion of the current job as the default setting for further jobs.

Figure 4:
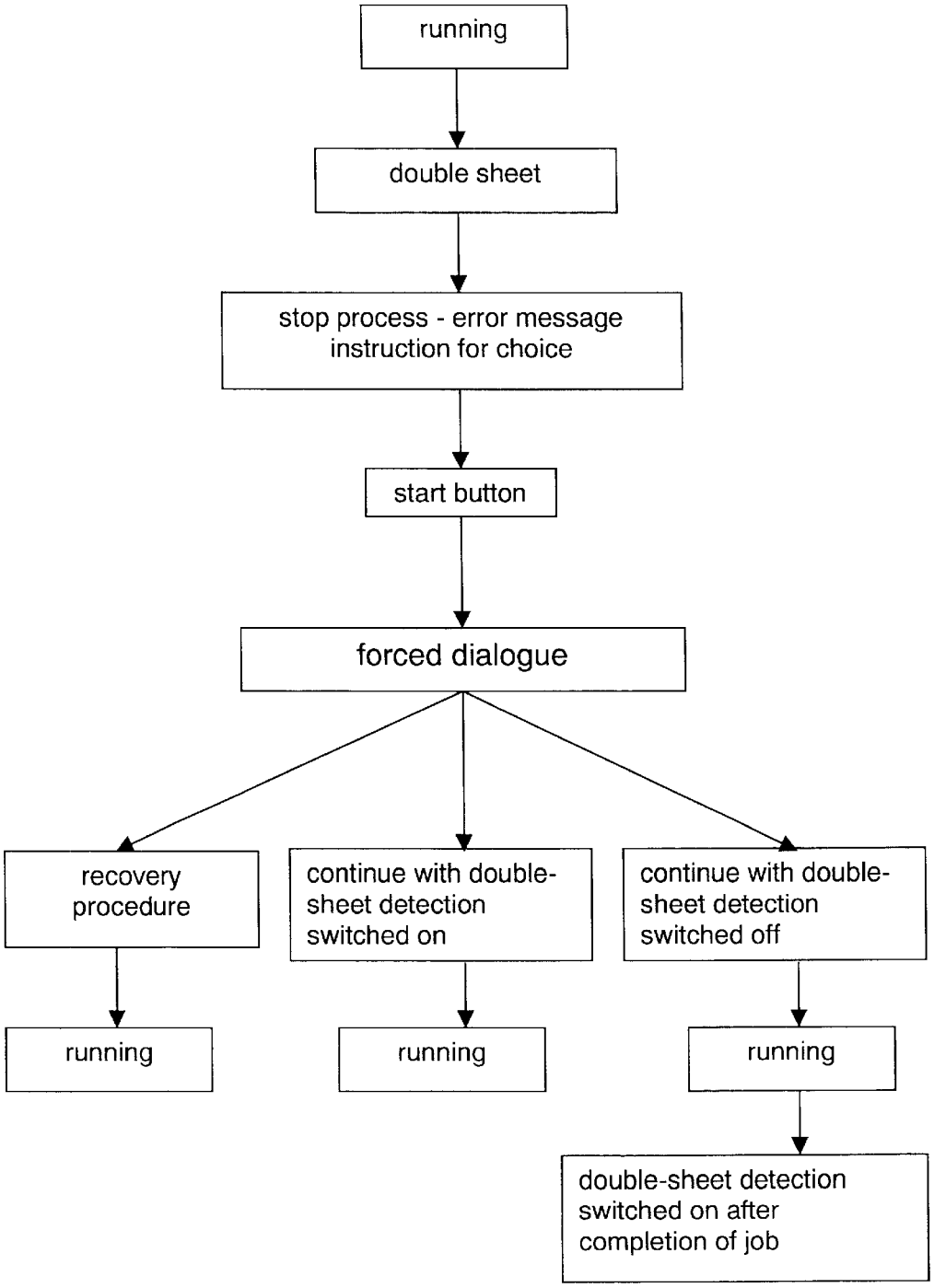
FIG. 4 is a flow diagram of an alternative control program according to the present invention.

In an alternative embodiment according to the present invention, the automatic feed of documents for copying is stopped upon a double-sheet detection and the operator is asked by means of the forced dialogue to select one of the following three options:

restore: this option enables originals adhering to one another to be separated by hand. In this case, the user can remove the original documents from the automatic feeder unit, restore the original sequence and place the complete original set back into the input tray of the automatic feed unit;

continue with the double-sheet detector switched on: this option enables the detected paste-up to be copied but the double-sheet detector remains switched on for the remaining set of documents for copying;

continuing with the double-sheet detector switched off: this option enables the detected paste-up to be copied and the remainder of the set to be processed without double-sheet detection. This choice is therefore suitable for sets of documents for copying comprising a number of paste-ups. After completion of the job, the double-sheet detector is automatically switched on again. The flow diagram for this alternative control program is shown in FIG. 4.

Where the invention refers to a double-sheet detector, this includes any means whereby it is possible to detect whether the document consists of a single sheet of a predetermined thickness or a document so differing therefrom with respect to thickness that it can no longer be considered a single-sheet document. In addition to the example of a paste-up, this class of documents also includes an original on extremely thick paper, for example photographic paper or card, if the automatic feed unit allows the transport thereof.

In the case of a device according to the present invention accessible to a larger group of operators, the double-sheet detector can be switched on or off by a key operator who can access the default settings by inputting a code. The normal mode may be that the detection is on in the default setting. Of course, the detector could also be easily switched on or off by means of a key. This will be convenient particularly in the case of a repro-machine for a professional operator.

The invention has been explained in the above embodiments; but it will, however, be clear to a person skilled in the art that it is possible to have other embodiments of the invention as described in the claims.

What is claimed is:

1. An image reproduction device, comprising an automatic feed unit for feeding documents;

a double-sheet detector for detecting more than one sheet as a document for copying;

an operator control unit provided with an operator control panel; and a control unit connected to said units for controlling the automatic feed unit, processing a signal from the double-sheet detector and controlling the operator control unit, wherein the operator control unit is adapted to offer a choice between switching the double-sheet detector on or off.

2. The device according to claim 1, wherein the operator control unit is adapted to offer, upon a double-sheet detection, a choice, by means of a forced dialogue, between switching the double-sheet detector off or leaving the double-sheet detector switched on.

3. The device according to claim 1, wherein a default setting of the double-sheet detector is "switched on", in the case of an automatic feed mode.

4. The device according to claim 1, wherein the automatic feed unit is provided with an optional manual feed mode.

5. The device according to claim 3, wherein the default setting for the double-sheet detector is "switched off" in the case of a manual feed mode.

6. The device according to claim 1, wherein the operator control unit is so adapted that when a job is completed with the double-sheet detector switched off, the double-sheet detector is switched on again.

7. The device according to claim 1, wherein the automatic feed unit is provided with a separating mechanism and the double-sheet detector is positioned within the automatic feed unit, preferably in close proximity to of the separating mechanism.

8. The device according to claim 1, containing one or more ultrasonic transmitter and receiver pairs as the double-sheet detector.

* * * * *